US007544453B2

(12) United States Patent
Freeman et al.

(10) Patent No.: US 7,544,453 B2
(45) Date of Patent: Jun. 9, 2009

(54) PHOTORECEPTOR WITH IMPROVED ELECTRON TRANSPORT

(75) Inventors: T. Edwin Freeman, Woodstock, GA (US); Nancy Belknap, Rochester, NY (US); John F. Yanus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 360 days.

(21) Appl. No.: 11/247,889

(22) Filed: Oct. 11, 2005

(65) Prior Publication Data

US 2007/0082283 A1 Apr. 12, 2007

(51) Int. Cl.
*G03G 5/14* (2006.01)

(52) U.S. Cl. ..... 430/60; 430/64; 430/131

(58) Field of Classification Search ..... 430/60, 430/64, 65, 131
See application file for complete search history.

(56) References Cited

U.S. PATENT DOCUMENTS

| | | | | |
|---|---|---|---|---|
| 4,464,450 | A | 8/1984 | Teuscher | |
| 4,518,669 | A | 5/1985 | Yashiki | |
| 4,579,801 | A | 4/1986 | Yashiki | |
| 4,775,605 | A | 10/1988 | Seki et al. | |
| 5,017,449 | A | 5/1991 | Yoshihara | |
| 5,344,734 | A | 9/1994 | Monbaliu et al. | |
| 5,385,796 | A | 1/1995 | Spiewak et al. | |
| 5,449,573 | A | 9/1995 | Aoki et al. | |
| 5,489,496 | A | 2/1996 | Katayama et al. | |
| 5,641,599 | A | 6/1997 | Markovics et al. | |
| 5,656,407 | A | 8/1997 | Kawahara | |
| 5,660,961 | A * | 8/1997 | Yu | 430/65 |
| 5,721,080 | A | 2/1998 | Terrell et al. | |
| 5,871,877 | A * | 2/1999 | Ong et al. | 430/58.8 |
| 5,874,193 | A * | 2/1999 | Liu et al. | 430/58.8 |
| 5,928,824 | A | 7/1999 | Obinata et al. | |
| 6,180,309 | B1 | 1/2001 | Maty et al. | |
| 6,200,716 | B1 | 3/2001 | Fuller et al. | |
| 6,207,334 | B1 | 3/2001 | Dinh et al. | |
| 6,287,737 | B1 * | 9/2001 | Ong et al. | 430/58.8 |
| 6,858,363 | B2 | 2/2005 | Belknap et al. | |
| 7,163,771 | B2 * | 1/2007 | Ioannidis et al. | 430/58.15 |

OTHER PUBLICATIONS

Diamond, A.S., ed., Handbook of Imaging Materials, Marcel Dekker, NY (1991), pp. 395 and 396.*

* cited by examiner

*Primary Examiner*—Janis L Dote
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to a photoreceptor that incorporates copolymers to that provide electron transporting functionality to improve image quality.

19 Claims, No Drawings

PHOTORECEPTOR WITH IMPROVED ELECTRON TRANSPORT

BACKGROUND

The invention relates generally to electrophotographic imaging members, such as layered photoreceptor structures, and processes for making and using the same. More particularly, the embodiments pertain to a photoreceptor that incorporates specific copolymers to facilitate electron transport across the undercoat layer of the photoreceptor device.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoat layer and, in some belt embodiments, an anticurl backing layer. In the multilayer configuration, the active layers of the photoreceptor are the charge generation layer (CGL) and the charge transport layer (CTL). Enhancement of charge transport across these layers provide better photoreceptor performance.

A suitable charge blocking layer is capable of forming an electronic barrier to hole transport between the adjacent photoconductive layer and the underlying conductive layer. The blocking layer may be applied by any suitable conventional technique such as spraying, dip coating, draw bar coating, gravure coating and the like. Generally, charge blocking layers for negatively charged photoreceptors allow electrons from the photoconductive layer of the imaging member to migrate toward and inject into the conductive layer. In various systems, the photoreceptor can be either negatively or positively charged which requires the development of suitable charge blocking layers. For example, in a negatively charged system the electron transporting functionality of binders included in undercoat layers will provide efficient injection and transportation of charge from the generator layer to the conductive ground plane by increasing the electron mobility in the bulk of the undercoat layer (UCL). Further, incorporation of such blocking layer materials helps reduce, and preferably substantially eliminates, the dark decay due to negative charging memory of the generator layer. These materials help reduce, and preferably substantially eliminate, dark decay by increasing the bulk electron transport in the undercoat layer and at the charge generator-undercoat layer interface. Reusability of the photoreceptors may be affected by substantial charge buildup that occurs as the materials are continually charged and discharged within a short time span. The significant buildup of charge due to the incomplete discharge of the imaging member may induce dielectric breakdown of the materials or of the layers resulting in print defects like charge deficient spots, or increased background development. Because the charge buildup affects the reusability of photoreceptors, incorporating materials that increase transport across the photoreceptor layers, enabling efficient and complete discharge, will lead to improved imaging members for high speed imaging applications.

Thus, as the demand for improved print quality in high speed xerographic reproduction increases, there is a need to better facilitate electron transport across photoreceptor layers to minimize or eliminate dark decay and residual voltage (Vr) due to the inability of charge to move efficiently through the imaging member.

The terms "charge blocking layer" and "blocking layer" are generally used interchangeably with the phrase "undercoat layer."

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are herein incorporate by reference.

Conventional undercoat layers are also disclosed in U.S. Pat. Nos. 4,464,450; 5,449,573; 5,385,796; 6,858,363; and Obinata et al, U.S. Pat. No. 5,928,824, which are herein incorporated by reference.

SUMMARY

According to embodiments illustrated herein, there is provided an improved process for efficient transport of charge across a single phase undercoat layer that addresses the problems described above.

In particular, an embodiment of the present invention provides an electrophotographic imaging member comprising a substrate, an undercoat layer formed on the substrate, wherein the undercoat layer comprises an electron transporting polymer synthesized from a polymeric substituted dicyanomethylene. fluorene, and at least one imaging layer formed on the undercoat layer.

Embodiments of the present invention also provide a process with which to prepare an imaging member, such as the photoreceptor, comprising forming a coating mixture having an electron transporting polymer, the polymer being synthesized from a polymeric substituted dicyanomethylene fluorene, applying the coating mixture on an electrophotographic imaging member, and causing the coating mixture to form an undercoat layer containing the electron transporting polymer.

DETAILED DESCRIPTION

It is understood that other embodiments may be utilized and structural and operational changes may be made without departure from the scope of the present invention.

Embodiments of the present invention relate to a photoreceptor having an undercoat layer which incorporates materials that help facilitate the transport of electrons across various interfaces in a photoreceptor device to provide good quality prints. The materials include electron transport copolymers that, when incorporated into undercoat layers, produce photoreceptors with highly efficient electron transport properties. Embodiments of the present invention relate to a photoreceptor having an undercoat layer which incorporates materials to facilitate the adhesion of the layer to the substrate and which also improve the surface properties of the undercoat layer to improve charge generator layer adhesion to the undercoat layer.

According to embodiments of the present invention, an electrophotographic imaging member is provided, which generally comprises at least a substrate layer, an undercoat layer, and an imaging layer. The imaging member may also include a charge generating layer and a charge transport layer. This imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

However, the reusability of the imaging member is affected by the efficiency of the charge transport across the photoreceptor layers. If charge transport is not conducted sufficiently across the various photoreceptor interfaces, charging memory of the generator layer or residual trapped charge will lead to dark decay and may lessen the print quality produced. Because typical photoreceptors have at least three layers, ensuring that charge transport across these layers is efficient will provide better photoreceptor performance by reducing the excessive buildup of charge within the imaging member that may lead to print defects such as charge deficient spots, and background development.

In embodiments, electron transport copolymers are synthesized and incorporated into undercoat layers to facilitate enhanced photoreceptor performance. Preparation begins with the synthesis of a polymeric substituted dicyanomethylene fluorene. In a particular embodiment, the polymeric substituted dicyanomethylene is vinylbenzyl 9-dicyanomethylene fluorene-4-carboxylate (VDFC). In that embodiment, the preparation begins with the synthesis of VDFC, followed by subsequent preparation of a copolymer of the VDFC with n-butylmethacrylate (BMA). In another embodiment, a terpolymer is formed by polymerizing the VDFC with BMA and vinylbenzyl alchohol (VBA). In this embodiment, the weight ratio of VDFC:VBA may be in a range of about 0.1:1 to about 5:1 or from about 0.3:1 to about 2:1. The resulting copolymer and terpolymer may be incorporated into undercoat layers for making photoreceptor devices with enhanced electron transport properties. In embodiments, the VDFC is present in an amount of about 60% by weight of the undercoat layer formed either with the copolymer or terpolymer. Some embodiments include undercoat layers having a thickness of from about 1 micrometer to about 10 micrometers. Dark decay is reduced in these embodiments by increasing the bulk electron transport property in the undercoat layer and across the charge generating-undercoat interface.

This undercoat layer represents an improvement over the prior art found in U.S. Pat. No. 6,200,716 and U.S. patent application Ser. No. 10/879,679, filed Jun. 29, 2004, now U.S. Pat. No. 7,163,771, entitled "Imaging Members," which are hereby incorporated by reference.

Single phase undercoat layers provide significant advantages to the dispersed particulate type undercoat layers by eliminating the need for extensive processing (both time & equipment) and eliminating stability problems typical of dispersions like particle agglomeration or settling in dispersed solutions. In dispersed undercoat layers the charge transport is effected primarily by conductive particles for example TiO2, ZnO and others. The dispersion quality can significantly impact the transport especially if the conductive particles are not uniformly dispersed within the layer which may lead to both electrical problems such as Vr rise and print defects. In this invention, the single phase solution undercoat layer incorporating the electron transport functionality directly on the binder leads to a very uniform and good quality layer.

The undercoat layer may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

EXAMPLES

The examples set forth hereinbelow and are illustrative of different compositions and conditions that can be used in practicing the invention. All proportions are by weight unless otherwise indicated. It will be apparent, however, that the invention can be practiced with many types of compositions and can have many different uses in accordance with the disclosure above and as pointed out hereinafter.

Example 1

Synthesis of Vinylbenzyl Acetate (1)

In a one liter 3-neck round bottom flask equipped with a condenser, mechanical stirrer and thermometer, 108 grams (0.708 mol) of vinylbenzyl chloride (60/40 m-/p-) and 808 grams (0.815 mol) of potassium acetate were added, followed by 250 mLs of DMSO. The mixture was stirred at 40° C. for 48 hours. After allowing to cool to room temperature, the mixture was diluted with water and poured into a separatory funnel. The organic layer was separated, followed by an extraction of the aqueous layer with chloroform. The combined organic layer was then washed with water, dried over magnesium sulfate and placed on the rotary evaporator to remove the chloroform. 120 grams of the vinylbenzyl acetate product was recovered, to which 10 mg of MEHQ was added as an inhibitor.

Example 2

Synthesis of Vinylbenzyl Alcohol (2)

120 grams (0.6876 mol) of vinylbenzyl acetate, inhibited with 10 mg of MEHQ were added to a one liter 3-neck round bottom flask equipped with a condenser, mechanical stirrer and thermometer, followed by 50 grams (1.25 mol) of sodium hydroxide. 50 mL of water and 300 mL of ethanol were then added and the contents of the flask heated at reflux (65° C.) for 2 hours. After the mixture was allowed to cool to room temperature, water was added. The content of the flask was poured into a separatory funnel and extracted with chloroform several times. The chloroform extract was subsequently washed several times with water and dried over magnesium sulfate. Removal of the chloroform on the rotary evaporator afforded 83 grams of the vinylbenzyl alcohol product (95% yield). The purification was accomplished by vacuum distillation.

Scheme 1: Synthesis of Vinylbenzyl Alcohol (VBA)

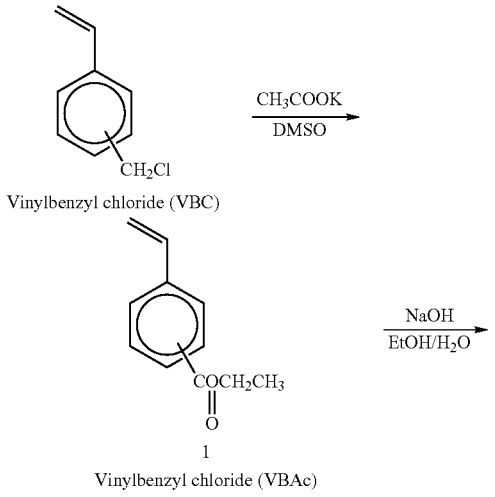

-continued

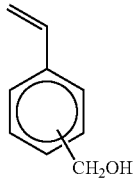

Example 3

Synthesis of Vinylbenzyl 9-fluorenone-4-carboxylate (4)

20 grams of (0.084 mol) of 9-fluorenone carboxylic acid and 14.3 grams (0.103 mol) of $K_2CO_3$ were added to 500 mL of 4:1 DMF/toluene in a one liter 3-neck round bottom flask equipped with a mechanical stirrer, a thermometer and a Dean-Stark trap topped with a water-cooled condenser. The flask was then heated at reflux to allow distillation of water/toluene azeotrope. After about 5 hours of reflux, the contents of the flask were allowed to cool to room temperature. 17 grams (0.111 mol) of vinylbenzyl chloride in 50 mL of DMF were next added dropwise from an addition funnel, and the flask was heated at 40° C. with stirring overnight. The content of the flask was then poured into ice water upon cooling to room temperature. The resulting precipitate was isolated by suction filtration, recrystallized from methanol and dried under vacuum at 60° C., to give 13.26 grams (44% yield) of the product.

Example 4

Synthesis of Vinylbenzyl 9-dicyanomethylene fluorene-4-carboxylate (5)

12.07 grams (0.035 mol) of vinylbenzyl 9-fluorenone-4-carboxylate and 2.79 grams (0.042 mol) of malononitrile were added to 300 mL of methanol in a 500 mL 3-neck round bottom flask equipped with a mechanical stirrer, a condenser and a thermometer, followed by 20 drops of piperidine. The mixture was then heated at reflux under nitrogen for 24 hours. The resulting orange-yellow precipitate was isolated by suction filtration, washed several times with methanol and dried under vacuum at 60° C. overnight.

Scheme 2. Synthesis of Vinylbenzyl 9-Dicyanomethylene Fluorene-4-Carboxylate

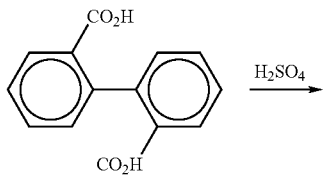

-continued

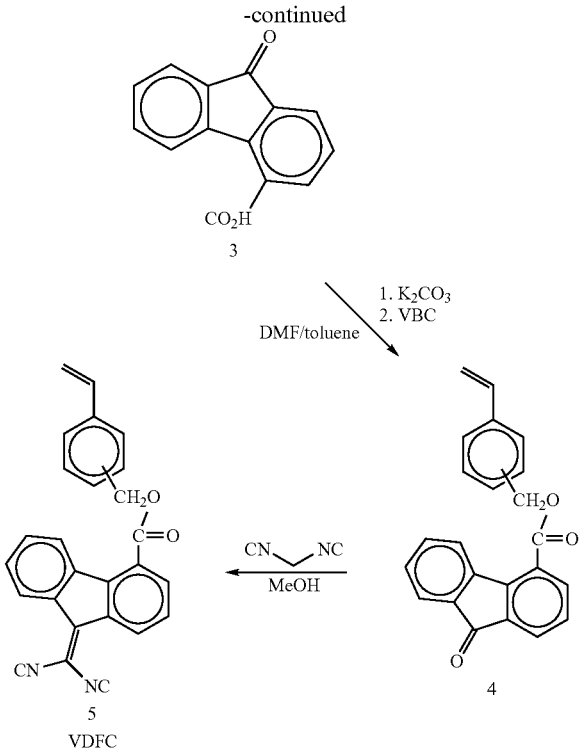

Example 5

Terpolymer—poly(BMA-co-VDFC-co-VBA)

10 grams of n-butyl methacrylate, 2 grams of vinylbenzyl 9-dicyanomethylene fluorene-4-carboxylate and 1.5 grams of vinylbenzyl alcohol were added to a 200 mL 3-neck round bottom 100 mL of toluene was added and the content stirred under nitrogen for 15 minutes. 0.2 grams of benzoyl peroxide was then added and stirring continued at 90° C. for 24 hours. Upon cooling to room temperature, the resulting polymer was precipitated by dropwise addition to hexane. The polymer was washed several times with methanol, followed by hexane and dried under vacuum at 60° C. overnight to give 6.2 grams of the product.

Example 6

Copolymer—poly(BMA-co-VDFC)

10 grams of n-butylmethacrylate and 3 grams of vinylbenzyl 9-dicyanomethylene fluorene-4-carboxylate were added to a 200 mL 3-neck round bottom flask. 100 mL of toluene was added and the content stirred under nitrogen for 15 minutes. 0.2 grams of benzoyl peroxide was then added and stirring continued at 90° C. for 24 hours. Upon cooling to room temperature, the resulting polymer was precipitated by drop-wise addition to hexane. The polymer was washed several times with methanol, followed by hexane and dried under vacuum at 60° C. overnight to give 5.2 grams of the product.

Example 7

Device Fabrication of Example 5

An electrophotographic imaging member was prepared by applying charge blocking layer solutions of the polymer synthesized in Example 5 which were prepared by dissolving 2 grams of poly(BMA-co-VDFC-co-VBA) in mL of THF, followed by filtration through 5 micron nylon ACRODISC filters. Using a Tsugiage coater, a charge blocking layer was fabricated onto the rough surface of an aluminum drum having a diameter of 3 cm and a length of 31 cm. The coating was applied at a coating bath withdrawal rate of 300 millimeters/minute. After drying in a forced air oven, the blocking layer has a thickness of 4.0 micrometers. The dried blocking layer was coated with a charge generating layer containing 3 weight percent hydroxygallium phthalocyanine pigment particles, 2 weight percent VMCH™, (polymer resin consisting of 86 weight percent vinyl chloride, 13 weight percent vinyl acetate, and 1 weight percent maleic acid by weight of the polymer and having a number average molecular weight of about 27,000 available from Union Carbide Co.), film forming polymer and 95 weight percent n-butyl acetate solvent. The coating was applied at a coating bath withdrawal rate of 300 millimeters/minute. After drying in a forced air oven, the charge generating layer has a thickness of 0.2 micrometer. The drum was subsequently coated with a charge transport layer containing N,N'-diphenyl-N,N'-bis(3-methylphenyl)-1,1;-biphenyl-4,4'-diamine dispersed in polycarbonate binder (PCZ 300, available from the Mitsubishi Chemical Company). The charge transport coating mixture consists of 8 weight percent N,N'-diphenyl-N,N'-bis(3-methylphenyl)-1,1'-biphehyl-4,4;-diamine, 12 weight percent binder, 60 weight percent tetrahydrofuran solvent and 20 weight percent monochlorobenzene solvent. The coating was applied in a Tsukiage dip coating apparatus. After drying in a forced air oven for 45 minutes at 118° C., the transport layer has a thickness of 20 micrometers.

Example 8

Device Fabrication of Example 6

An electrophotographic imaging member was prepared by applying charge blocking layer solutions of the polymer synthesized in Example 6 which were prepared by dissolving 2 grams of poly(BMA-co-VDFC) in mL of THF, followed by filtration through 5 micron nylon ACRODISC filters. Using a Tsugiage dip coater, a charge blocking layer was fabricated onto the rough surface of an aluminum drum having a diameter of 3 cm and a length of 31 cm. The subsequent fabrication steps for making the device are the same as in Example 7.

Example 9

An electrophotographic imaging member was prepared by applying charge blocking layer solutions of the polymer synthesized in Example 5 which were prepared by dissolving 2 grams of poly(BMA-co-VDFC-co-VBA) and 0.4 grams of Z-6040™ adhesion promoter (3-glycidoxypropyltrimethoxysilane available from Dow Corning) in 13 mL of THF, followed by filtration through 5 micron nylon ACRODISC filters. Using a Tsugiage dip coater, a charge blocking layer was fabricated onto the rough surface of an aluminum drum having a diameter of 3 cm and a length of 31 cm. The subsequent fabrication steps for making the device are the same as in Example 7.

Example 10

Comparative Example—PVBA with Z-6040™

An electrophotographic imaging member was prepared by applying charge blocking layer solutions of the PVBA polymers described in U. S. Pat. No. 6,200,716 and pending application Ser. No. 10/808,679, now U.S. Patent Publication No. 2005/0250027. A charge blocking layer solution containing 3.75 grams of PVBA polymer, 1.5 grams of Z-6040™ adhesion promoter [3-glycidoxypropyltrimethoxysilane available from Dow Corning] in 21.25 grams of ethyl alcohol. Using a Tsugiage dip coater, a charge blocking layer was fabricated onto the rough surface of an aluminum drum having a diameter of 3 cm and a length of 31 cm. The subsequent fabrication steps for making the device are the same as in Example 7.

Example 11

Comparative Example—Dispersed Particulates

An electrophotographic imaging member was prepared by applying charge blocking layer solutions of a particulate titanium oxide/silica dispersed undercoat layer, as described in U.S. Pat. No. 6,177,219, which is hereby incorporated by reference. A solution containing 52 grams titanium dioxide, 10 grams silicon dioxide and 38 grams of Varcum phenolic resins were dissolved in 27.8 grams of 1:1 1-butanol:xylene. Using a Tsugiage dip coater, a charge blocking layer was fabricated onto the rough surface of an aluminum drum having a diameter of 3 cm and a length of 31 cm. The subsequent fabrication steps for making the device are the same as in Example 7.

Electrical Test Results

The full photoreceptor devices were electrically tested in a constant current scanner operating at 40 rpm in a 22 C, 30% RH environment. The novel polymers of this invention had good film forming characteristics and showed excellent functionality as single-phase undercoat layer materials as shown by the following tests. The resulting photoreceptor devices were electrically tested with a cyclic scanner set to obtain 100 charge-erase cycles immediately followed by an additional 100 cycles, sequenced at 2 charge-erase cycles and 1 charge-expose-erase cycle, wherein the light intensity was incrementally increased with cycling to produce a photoinduced discharge curve from which the photosensitivity was measured. The scanner was equipped with a single wire corotron (5 centimeters wide) set to deposit 70 nanocoulombs/cm2 of charge to obtain an initial potential (Vo) of about 700V on the surface of the drum devices.

The devices were tested in the negative charging mode. The exposure light intensity was incrementally increased by means of regulating a series of neutral density filters, and the exposure wavelength was controlled by a band filter at 780±5 nanometers. The exposure light source was a 1,000 watt Xenon arc lamp white light source. The drum was rotated at a speed of 40 rpm to produce a surface speed of 62.8 millimeters/second or a cycle time of 1.5 seconds. The xerographic simulation was carried out in an environmentally controlled light tight chamber at ambient conditions (50 percent relative humidity and 22° C.) and at low temperature and low (LL) conditions (10 percent relative humidity and 15° C.).

The dark discharge of the photoreceptor was measured by monitoring the surface potential after applying a single charge cycle of 80 nanocoulombs/cm$^2$ (without erase). Photosensitivity (dV/dx) was calculated from the initial discharge rate at low exposure intensity, determined at about 70 percent of the initial voltage or Vzero (of about 0 to about 0.7 erg/cm$^2$ exposure). The residual voltage (Vr) of the photoreceptor was measured at 13 erg/cm$^2$ exposure.

TABLE 1

| | Discharge Characteristics | | | | | |
|---|---|---|---|---|---|---|
| Device | −Vo | dV/dx | Vr Ambient | Vr LL | Vlow @ 2.8 erg/cm$^2$ Ambient | DD (V/s) |
| Example 7 | 725 | 345.4 | 36.9 | 77.2 | 118.7 | 10.3 |
| Example 8 | 721 | 435 | 59.1 | 115.3 | 114 | 13.7 |
| Example 11 | 731 | 494 | 120 | N/A | 145 | 17.5 |
| Example 10 | 701 | 446 | 98.2 | 239 | 166 | 21.7 |
| Example 9 | 716 | 381 | 39.2 | 98.6 | 86.8 | 16.7 |

Discharge Characteristics

Excellent discharge characteristics were obtained as shown in Table 1. The PIDCs of all samples are fairly sharp and linear to 80% of Vo or about 140V, however the novel polymers of this invention have sharper discharge curves as reflected by Vlow (discharge potential) measured at 2.8 erg/cm$^2$ exposure. The low residual voltage (Vr) produced in the photo induced discharge curve (PIDC) demonstrates the ability of the undercoat layers prepared with either the copolymer of example 8 or the terpolymer of example 9 to efficiently move electrons from the charge generating layer to the substrate as shown by the significantly lower Vr relative to the comparative examples. This improvement is also demonstrated by the decrease in Vr at the stress conditions presented by the LL test environment. The photosensitivity (dV/dx) and dark discharge (DD) is consistent with that typically observed for Pc7 pigment on other undercoat layers. The charge generating layer coverage on the terpolymer is slightly lower than on the copolymer sample, which is reflected by the lower photosensitivity. The addition of the Z-6040™ adhesion promoter is shown to greatly improve the adhesion of the CGL to the UCL as shown by the increased photosensitivity in example 10 as compared with example 7.

Cycling Data

The photoreceptor devices of example 7, example 8 and example 10 were electrically cycled under constant current charging with the initial voltage set to 700V. The devices were cycled for three thousand cycles at 80 rpm with erase light set to achieve maximum discharge of the device. Both devices prepared with the undercoat layers utilizing the novel polymeric electron transport material exhibit excellent cyclic behavior with no evidence of cycle-up or cycle-down in Vo or Vr. This demonstrates an improvement over the example 10 that exhibits Vr cycle-up of about 30V.

What is claimed is:

1. An electrophotographic imaging member comprising:

a conductive substrate;

an undercoat layer formed on the conductive substrate, wherein the undercoat layer comprises a polymeric electron transport material including a polymeric substituted dicyanomethylene fluorene; and at least one imaging layer formed on the undercoat layer, wherein the undercoat layer comprises an adhesion promoter that is 3-glycidoxypropyltrimethoxysilane.

2. The electrophotographic imaging member of claim 1, wherein the at least one imaging layer includes a charge generating layer and a charge transport layer.

3. The electrophotographic imaging member of claim 1, wherein the polymeric substituted dicyanomethylene fluorene is vinylbenzyl 9-dicyanomethylene fluorene-4-carboxylate.

4. The electrophotographic imaging member of claim 3, wherein the polymeric electron transport material includes a copolymer of vinylbenzyl 9-dicyanomethylene fluorene-4-carboxylate and n-butyl methacrylate.

5. The electrophotographic imaging member of claim 4, wherein vinylbenzyl 9-dicyanomethylene fluorene-4-carboxylate is present in an amount of about 60% by weight of the undercoat layer.

6. The electrophotographic imaging member of claim 3, wherein the polymeric electron transport material includes a terpolymer of vinylbenzyl 9-dicyanomethylene fluorene-4-carboxylate, n-butyl methacrylate, and vinylbenzyl alcohol.

7. The electrophotographic imaging member of claim 6, wherein vinylbenzyl 9-dicyanomethylene fluorene-4-carboxylate is present in an amount of about 60% by weight of the undercoat layer.

8. The electrophotographic imaging member of claim 6, wherein the weight ratio of vinylbenzyl 9-dicyanomethylene fluorene-4-carboxylate to vinylbenzyl alcohol is in a range of about 0.1:1 to about 5:1.

9. The electrophotographic imaging member of claim 6, wherein the weight ratio of vinylbenzyl 9-dicyanomethylene fluorene-4-carboxylate to vinylbenzyl alcohol is in a range of about 0.3:1 to about 2:1.

10. The electrophotographic imaging member of claim 1, wherein thickness of the undercoat layer is from about 1 micrometer to about 10 micrometers.

11. The imaging member of claim 1, wherein the conductive substrate is an aluminum drum.

12. A process for preparing an electrophotographic imaging member, comprising:

forming a coating mixture having a polymeric electron transport material, wherein the material includes a polymeric substituted-dicyanomethylene fluorene, and an adhesion promoter that is 3-glycidoxypropyltrimethoxysilane;

applying the coating mixture on a conductive substrate; causing the coating mixture to form an undercoat layer containing the polymeric electron transport material and the adhesion promotor; and forming at least one imaging layer on the undercoat layer.

13. The process of claim 12, wherein the polymeric substituted dicyanomethylene fluorene is vinylbenzyl 9-dicyanomethylene fluorene-4-carboxylate.

14. The process of claim 13, wherein the polymeric electron transport material includes a copolymer of vinylbenzyl 9-dicyanomethylene fluorene-4-carboxylate and n-butyl methacrylate.

15. The process of claim 13, wherein the polymeric electron transport material includes a terpolymer of vinylbenzyl 9-dicyanomethylene fluorene-4-carboxylate, n-butyl methacrylate, and vinylbenzyl alcohol.

16. The process of claim 12, wherein drying causes the coating mixture to form the undercoat layer.

17. The process of claim 12, wherein the at least one imaging layer includes a charge generating layer and a charge transport layer.

18. The process of claim 12, wherein thickness of the undercoat layer is from about 1 micrometer to about 10 micrometers.

19. The process of claim 12, wherein the conductive substrate is an aluminum drum.

* * * * *